US010992082B2

(12) United States Patent
Leroy et al.

(10) Patent No.: US 10,992,082 B2
(45) Date of Patent: Apr. 27, 2021

(54) IMPEDANCE-MATCHING CONNECTION DEVICE

(71) Applicant: Zodiac Data Systems, Courtaboeuf (FR)

(72) Inventors: Mathieu Leroy, Paris (FR); Patrick Saublet, Paris (FR)

(73) Assignee: Zodiac Data Systems

( * ) Notice: Subject to any disclaimer, the term of this patent is extended or adjusted under 35 U.S.C. 154(b) by 0 days.

(21) Appl. No.: 16/482,535

(22) PCT Filed: Feb. 1, 2018

(86) PCT No.: PCT/EP2018/052543
§ 371 (c)(1),
(2) Date: Jul. 31, 2019

(87) PCT Pub. No.: WO2018/141858
PCT Pub. Date: Aug. 9, 2018

(65) Prior Publication Data

US 2020/0251858 A1 Aug. 6, 2020

(30) Foreign Application Priority Data

Feb. 1, 2017 (FR) ..... 1750846

(51) Int. Cl.
*H01R 13/6473* (2011.01)
*H01R 12/71* (2011.01)
*H01R 31/06* (2006.01)

(52) U.S. Cl.
CPC ..... *H01R 13/6473* (2013.01); *H01R 12/716* (2013.01); *H01R 31/06* (2013.01)

(58) Field of Classification Search
CPC ... H01R 13/6473; H01R 12/716; H01R 31/06
See application file for complete search history.

(56) References Cited

U.S. PATENT DOCUMENTS 8,075,477 B2 * 12/2011 Nakamura ..... A61B 1/0011 600/132
9,450,338 B2 * 9/2016 Reeves ..... H01R 13/631
(Continued)

FOREIGN PATENT DOCUMENTS

CN 205666414 U 10/2016
EP 1271698 A1 * 1/2003 ..... H01R 12/79
(Continued)

OTHER PUBLICATIONS

International Search Report from Application No. PCT/EP2018/052543 dated Apr. 16, 2018, 2 pages.
(Continued)

*Primary Examiner* — Abdullah A Riyami
*Assistant Examiner* — Nader J Alhawamdeh
(74) *Attorney, Agent, or Firm* — Lerner, David, Littenberg, Krumholz & Mentlik, LLP

(57) ABSTRACT

The invention relates to a connection device comprising: a socket body qualified according to a first standard, the socket body being hollow and intended to be attached to a panel of an onboard item of equipment; an external connector securely housed in the socket body, the external connector being defined according to a second, different and less robust standard; an internal connector linked to the external connector; a flexible, impedance-matched transition housed at least partially in the socket body and positioned between the external connector and the internal connector, which is configured, when in operation, to match the impedance of the lines passing between the internal connector and the external connector.

5 Claims, 8 Drawing Sheets

(56) References Cited

U.S. PATENT DOCUMENTS

| | | | | |
|---|---|---|---|---|
| 2010/0041268 | A1 | 2/2010 | Okada et al. | |
| 2014/0148019 | A1* | 5/2014 | Sasaki | H01R 12/585 439/65 |
| 2019/0074631 | A1* | 3/2019 | Bowman | H01R 13/623 |
| 2020/0080417 | A1* | 3/2020 | Pomerleau | E21B 47/06 |

FOREIGN PATENT DOCUMENTS

| | | | |
|---|---|---|---|
| EP | 1271698 | A1 | 1/2003 |
| WO | 2012085397 | A1 | 6/2012 |
| WO | 2016022678 | A1 | 2/2016 |

OTHER PUBLICATIONS

Preliminary Search Report for Application No. FR 1750846 dated Sep. 25, 2017, 2 pages.

* cited by examiner

IMPEDANCE-MATCHING CONNECTION DEVICE

CROSS-REFERENCE TO RELATED APPLICATIONS

The present application is a national phase entry under 35 U.S.C § 371 of International Application No. PCT/EP2018/052543, filed Feb. 1, 2018, which claims priority from French Application No. 1750846, filed Feb. 1, 2017, all of which are hereby incorporated herein by reference.

GENERAL TECHNICAL FIELD AND PRIOR ART

The invention relates to a connection device for connect an auxiliary interface for fast bus (USB3.0, Eth10Gb, DVI, etc.) of an item of equipment subject to demanding robustness standards (of aeronautic or military type) directly to a public terminal of portable computer or tablet type.

PRIOR ART

An onboard item of equipment typically comprises an electric interface for fast bus (USB3.0, Eth10Gb, DVI, . . . ) for allowing a user to load or unload large volumes of data from a computer or non-hardened peripheral fitted with a cable terminated by a commercial standard plug.

According to need, the onboard equipment must be certified for aeronautics or military and its connector socket must be robust (mechanical robustness and electromagnetic robustness) and tightly sealed (humidity).

Connection devices in the military and aeronautic range (MIL-DTL-38999 for example) are known which transmit high bandwidth signals on << quadrax >> or coaxial contacts while retaining the integrity of the signal and the compatibility with the constraints of onboard equipment.

Yet this needs a specific cable between this connection device based on << quadrax >> or coaxial and a unit which has commercial connectors (USB, eSATA, DVI, HDMI, Ethernet . . . ). FIG. 1 illustrates such a device connection 100 with its 200 Ethernet cable to be connected to a commercial PC.

Sealed sockets which deport the commercial standard socket via a partition wall are also known, but in this case the internal link to the equipment incorporates a plug and a cable non-compliant with certification requirements. FIG. 2 illustrates such a connection device 100' with the internal cable 300 (here a USB cable).

PRESENTATION OF THE INVENTION

An aim of the invention is to have a connection device whereof the external electrical interface is matched to the current commercial standard of the computer hardware (USB, eSATA, DVI, HDMI, Ethernet, . . . ) inserted into a socket certified according to an aeronautic, military or equivalent standard. The invention allows the internal transition which connects this connection device to the electronic circuit to be both robust and impedance-matched on a high bandwidth.

To this end, the invention proposes a connection device comprising:

a socket body qualified according to a first standard, the socket body being hollow and intended to be fixed to a panel of an onboard item of equipment;

an external connector housed fixed in the socket body, the external connector being defined according to a second different and less robust standard;

an internal connector connected to the external connector;

a flexible impedance-matched transition housed at least partially in the socket body and arranged between the external connector and the internal connector configured, when operating, to adapt the impedance of the lines transiting between the internal connector and the external connector.

The invention is advantageously completed by the following characteristics taken singly or in any of their technically possible combinations:

- the adapted transition comprises a flexible circuit connecting a first printed circuit supporting the external connector and a second printed circuit supporting the internal connector;
- the device comprises a support plate on which the first printed circuit supporting the external connector is fixed;
- The device comprises a cylinder enclosing the external connector;
- the internal connector and/or the external connector are respectively fixed on the first printed circuit and/or on the second printed circuit;
- the cylinder is constituted by solidified material such as a resin;
- the socket body is compatible with the standard MIL-DTL-38999, MIL-DTL-22992, MIL-DTL-26482.

PRESENTATION OF FIGURES

Figure 1:
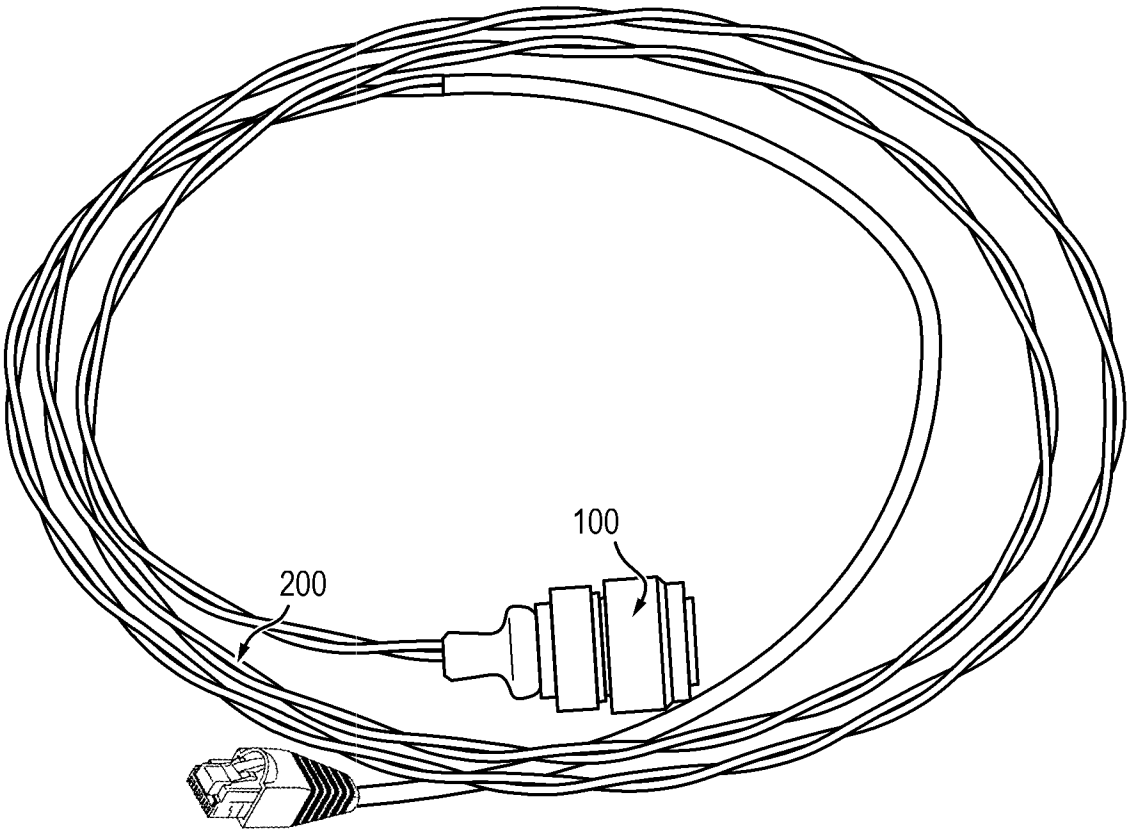
FIG. 1 is a top view of a first connector according to the prior art.
Figure 2:
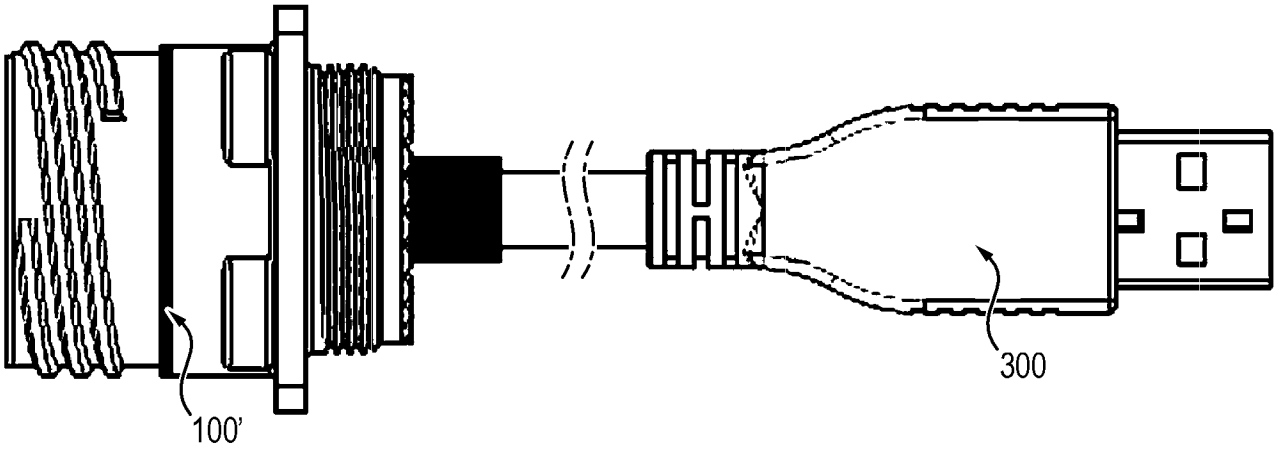
FIG. 2 is a top view of a second connector according to the prior art.
Figure 3:
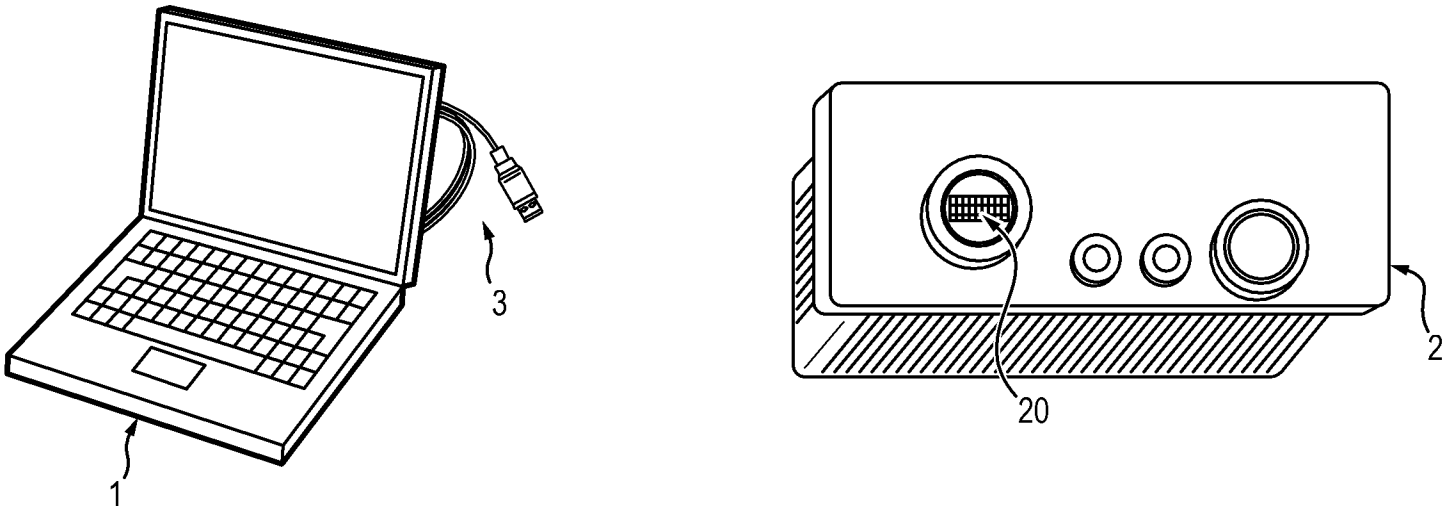
Figure 4:
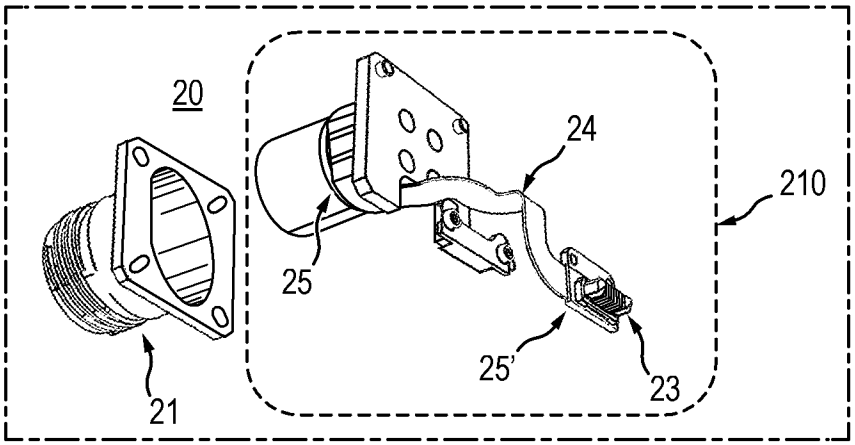
Figure 6:
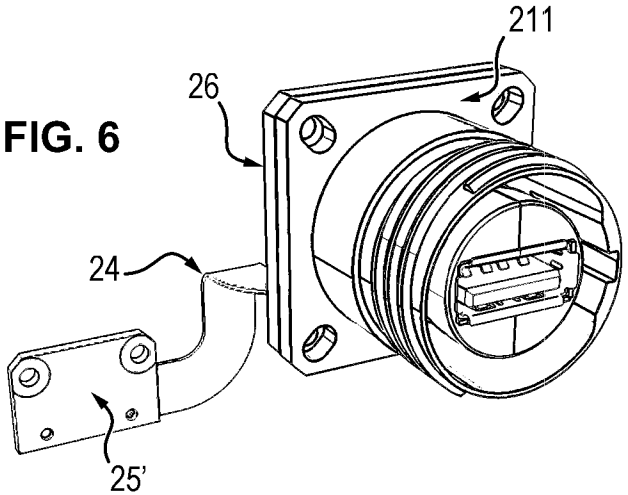
Figure 8:
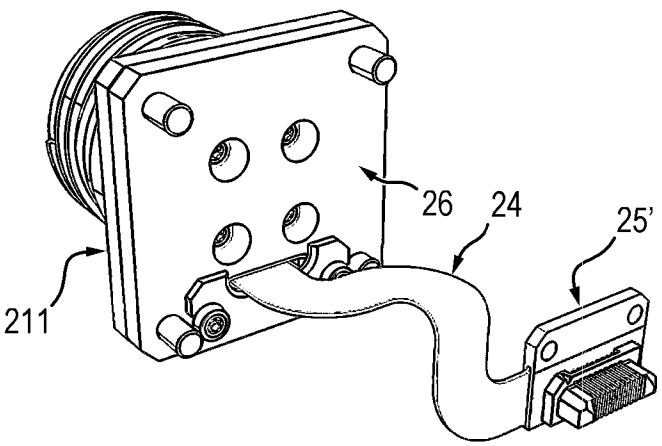
Figure 5:
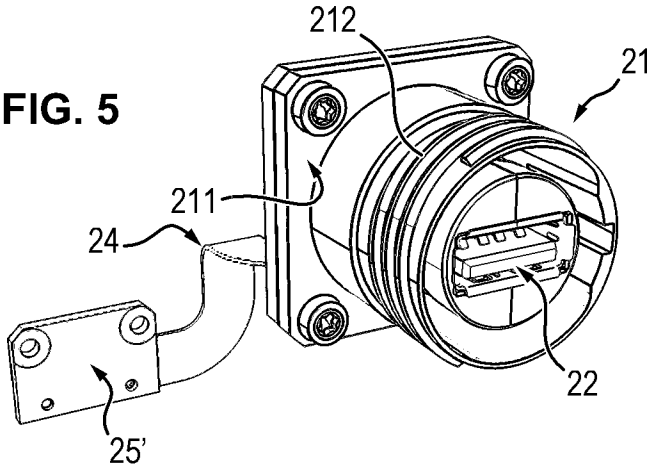
Figure 7:
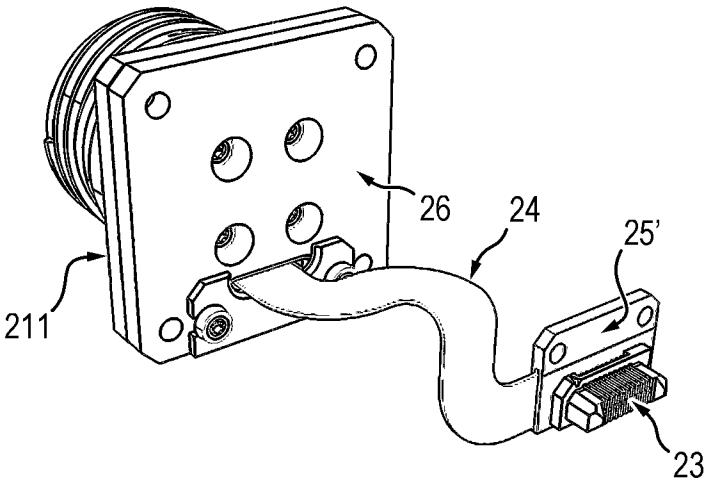
Figure 10:
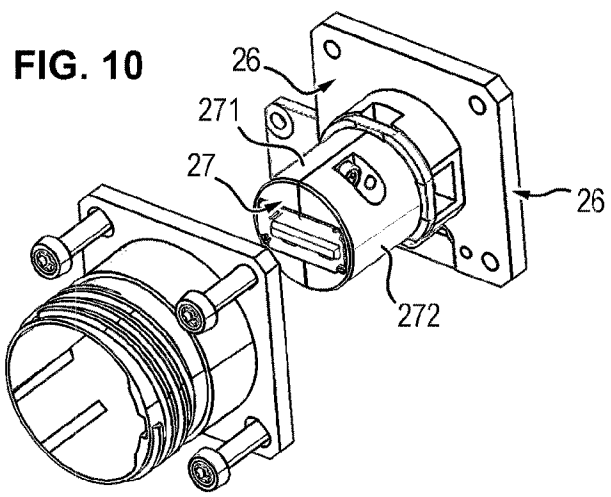
Figure 12:
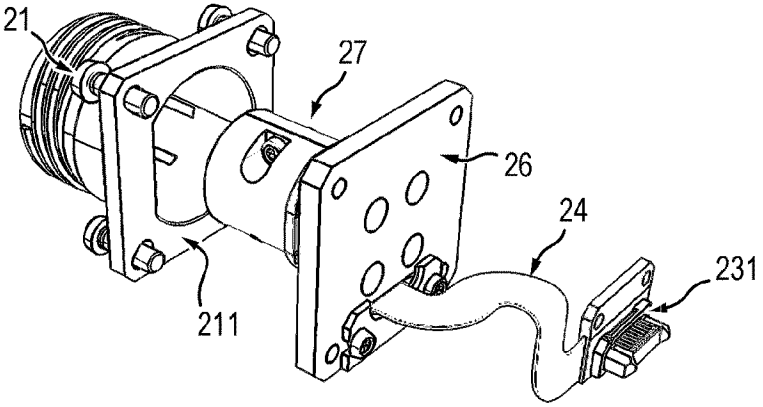
Figure 9:
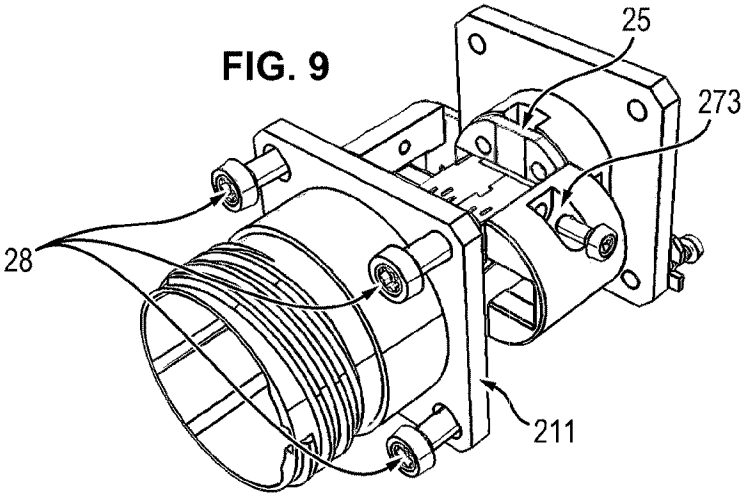
Figure 11:
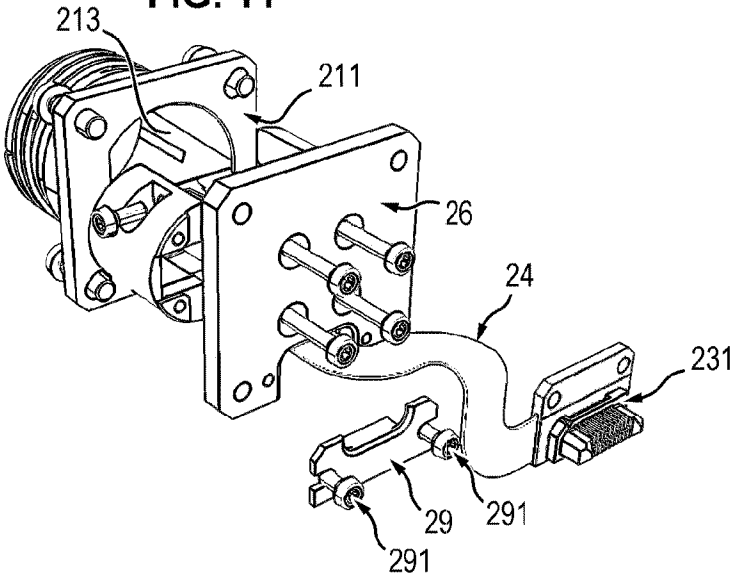
Figure 14:
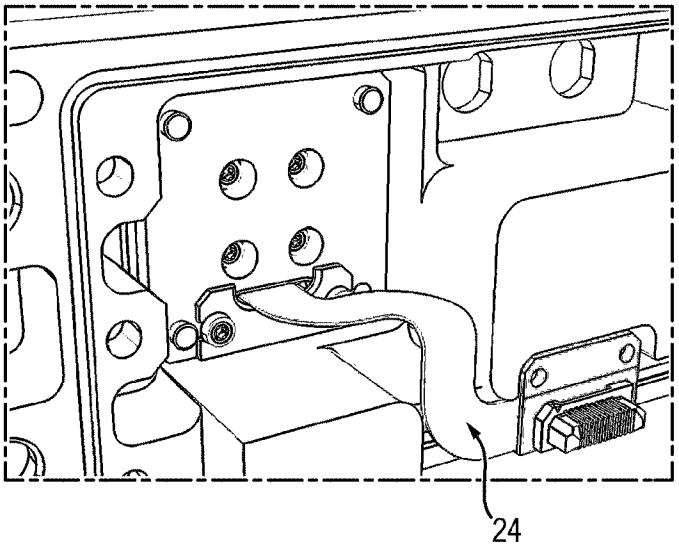
Figure 16:
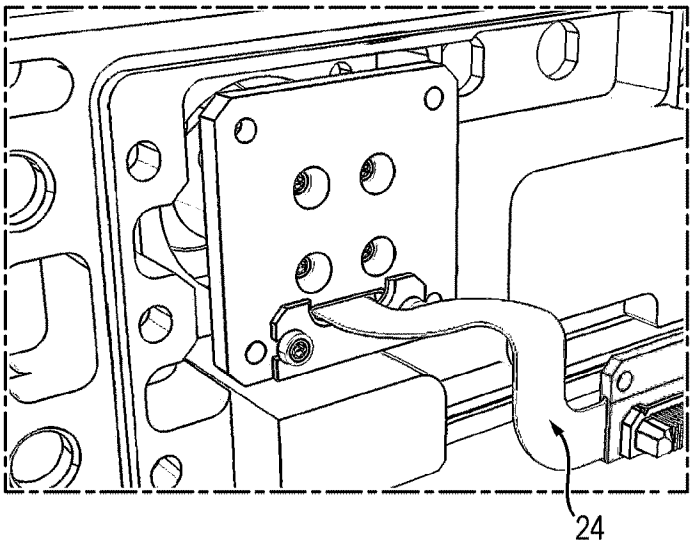
Figure 13:
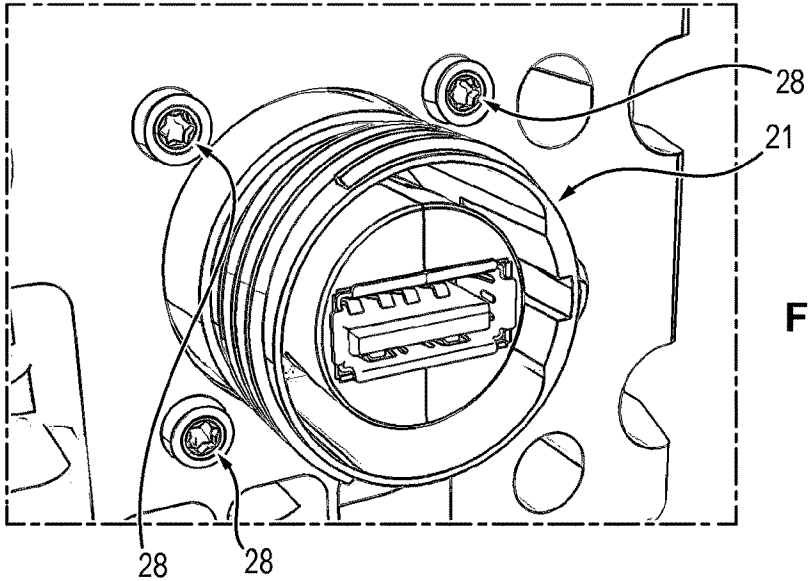
Figure 15:
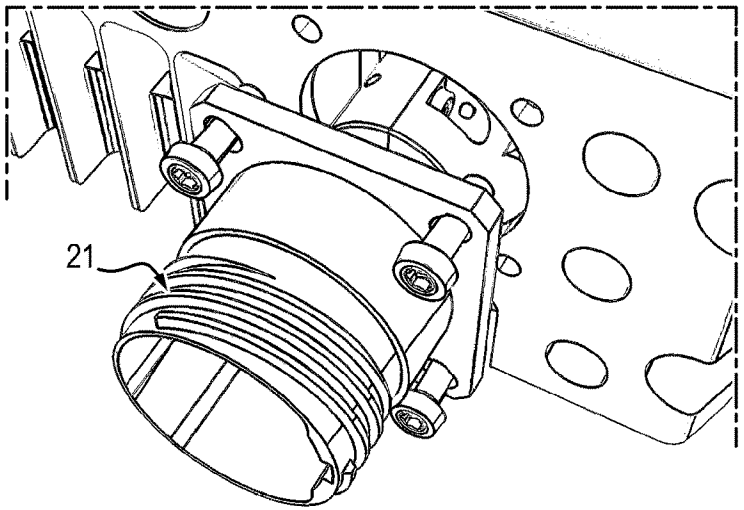
Figure 18:
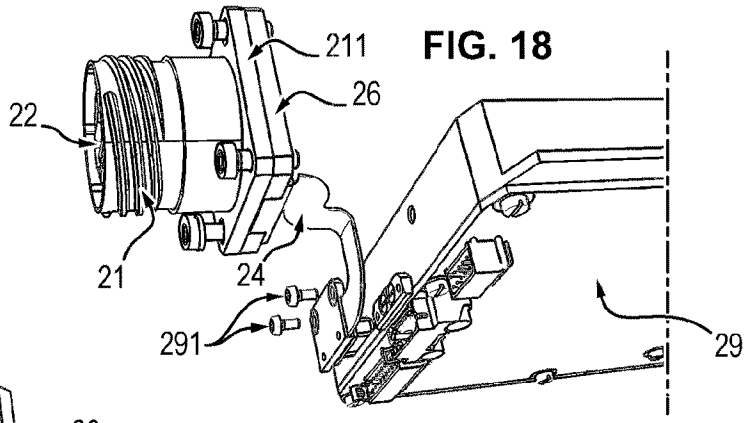
Figure 17:
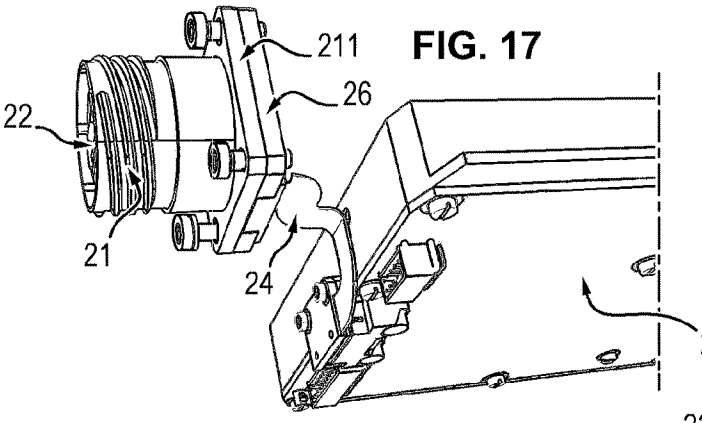
Figure 19:
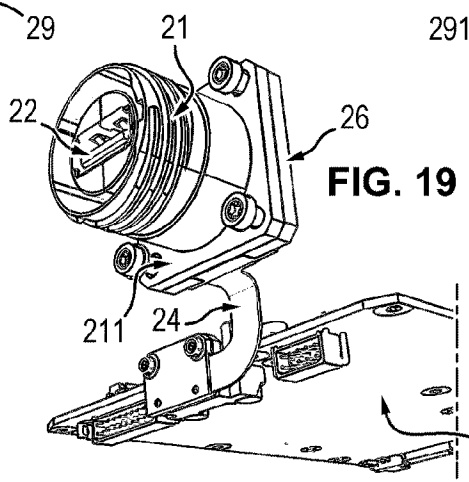
Figure 21:
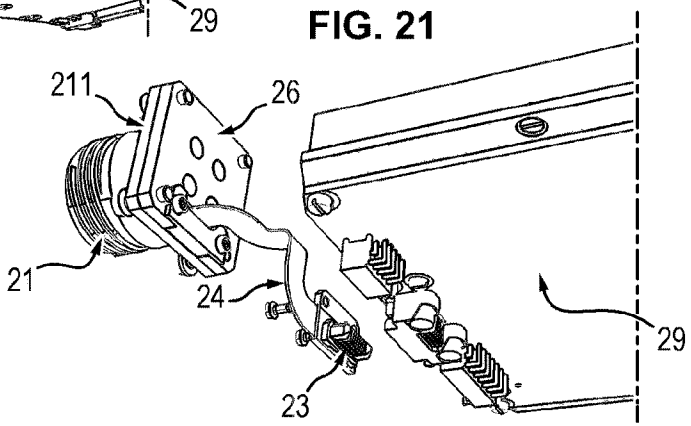
Figure 20:
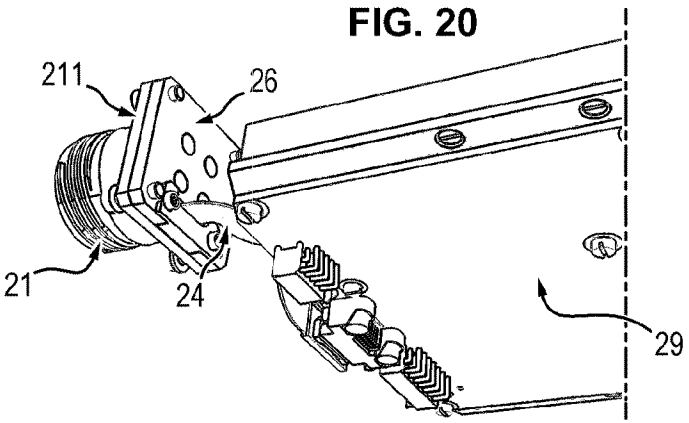
Figure 22:
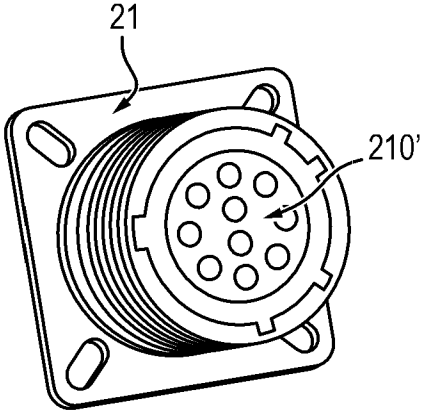

Other characteristics, aims and advantages of the invention will emerge from the following description which is purely illustrative and non-limiting and which must be considered with respect to the appended drawings, apart from FIGS. 1 and 2 already discussed:

FIG. 3 is a perspective view that illustrates use of a device according to the invention;

FIG. 4 is an exploded oblique view of the device;

FIG. 5 is an oblique view of the device in a fastened state from a first perspective;

FIG. 6 is an oblique view of the device in an unfastened state from the first perspective;

FIG. 7 is an oblique view of the device in an unfastened state from the a second perspective;

FIG. 8 is an oblique view of the device in a fastened state from the second perspective;

FIG. 9 is an oblique view of the device from a third perspective in a first exploded state;

FIG. 10 is an oblique view of the device from the third perspective in a second exploded state;

FIG. 11 is an oblique view of the device form a fourth perspective in the first exploded state;

FIG. 12 is an oblique view of the device from the fourth perspective in the second exploded state;

FIG. 13 is an oblique view of the device in a partially assembled state from a fifth perspective;

FIG. 14 is an oblique view of the device in the first partially assembled state form a sixth perspective;

FIG. 15 is an oblique view of the device in a second partially assembled state from a seventh perspective;

FIG. 16 is an oblique view of the device in the second partially assembled state from the sixth perspective;

FIG. 17 is an oblique view of the device fastened to a card from an eighth perspective;

FIG. 18 is an oblique view of the device unfastened from the card from the eighth perspective;

FIG. 19 is an oblique view of the device fastened to teh card from a ninth perspective;

FIG. 20 is an oblique view of the device fastened to the card from a tenth perspective;

FIG. 21 is an oblique view of the device unfastened from the card from the tenth perspective; and FIG. 22 is an oblique view of a connector defined according to a first standard.

In all figures similar elements bear identical reference numerals.

DETAILED DESCRIPTION OF THE INVENTION

FIG. 3 illustrates a terminal 1 of commercial portable computer type (a terminal can also be a tablet, a smartphone or any other terminal adapted to be connected to a peripheral) which can be connected to an item of equipment 2 of onboard type via a commercial cable 3. Such a cable 3 comprises a plug of current public standard (in FIG. 1 a plug of USB standard).

The cable 3 is connected to the equipment 2 via an external connector accessible via the front face of a panel of the equipment 2 by way of a device 20 illustrated in FIGS. 2 to 16.

The connection device 20 comprises a body 21 socket qualified according to a first standard. A first standard is for example the standard MIL-DTL-38999, the standard MIL-DTL-22992, the standard MIL-DTL-26482 or more generally any standard qualified for severe environment (in aeronautics, defense or in aerospace especially).

FIG. 22 illustrates a connector defined according to the first standard and which conventionally comprises the cylindrical socket body 21 housing contacts 210' and forming a connector known as complete.

The body 21 socket is especially qualified in that it is configured to be robust and impervious, to support severe environments provided by its standard.

An assembly 210 comprising an external connector 22 defined according to a second commercial standard, potentially intended for public use in a domestic environment, is housed inside the body 21 socket and held by a mechanical interface described later, not defined by standards.

The external connector 22 is however not qualified. In other words, a socket body without its contacts (that is, hollow and empty) is assumed for housing a commercial connector 22 (also comprising a socket body and contacts). The contacts 210' leave space for the assembly 210 comprising the external connector 22.

An internal connector 23 is connected to the external connector 22.

As shown in the figures, by way of non-limiting example, the external connector 22 is of USB type.

The internal connector 23 connects to a card of the equipment 2.

FIGS. 17 to 21 illustrate the internal connector 23 connected to a card 29 of the equipment 2.

Also, the device 20 comprises an impedance-matched transition 24, 25, 25' between the external connector 22 and the internal connector 23 configured, when operating, to adapt the impedance of the lines transiting between the internal connector 23 and the external connector 22. The adapted transition 24, 25, 25' is preferably housed at least partially in the socket body.

By way of advantage, the adapted transition 24, 25, 25' comprises a flexible circuit 24 connecting by lines of controlled impedance a first printed circuit 25 supporting the external connector 22 and a second printed circuit 25' supporting the internal connector 23. It is the series connection of these elements (flexible circuit, printed circuits) which ensures continuity of transmission of the signal in the connection device by respecting the line impedance right along the trajectory of the latter.

The printed circuits 25-25' can be etched with ground planes to ensure shielding for electromagnetic compatibility. Similarly, on these circuits prints performing the impedance matching of the transition between their connector and the flexible circuit and/or filtering functions can be etched.

The internal connector 23 is welded onto the second printed circuit 25' which allows it to be selected smaller in size than the external connector 22 au format grand public. In fact, using a printed circuit allows very low resolution between two adjacent contacts (of the order of 250 μm).

The connector 23 can be connected to the equipment card 29 robustly by screws 291 which fix the connector 23 to the card by ensuring a mechanical hold responding to the restrictions of the onboard.

The flexible circuit is for example a single electronic circuit comprising two rigid ends (printed circuits 25, 25') connected by a multilayer flat cable (for example: layers of polyamide film taken in layers of epoxy at the ends). The technology of the printed circuit prolonged by a flat cable guarantees impedance constancy with the minimum of transition rupture.

The connector 23 respects the impedance matching in a broad passband, from the onboard card, where the controller of the fast bus (for example a USB 3.0 driver) is located, as far as the external connector.

The first printed circuit 25 is fixed on a support plate 26. The form and the dimensions of the support plate 26 are such that the latter is fixed to the socket body 21, in particular on its fastening plate 211 by means of screws 28 (four here). These screws 28 also fix the connection device onto the front face of the equipment 2.

The socket body 21 is constituted by this fastening plate 211 from which a tube 212 extends. It is inside the tube 212 where the external connector 22 is housed, held by the solid assembly constituted by the printed circuit 25 and the support plate 26. The specific form of the support plate 26 and printed circuit 25 assembly positions the end of the external connector 22 at the centre and at the level of the opening of the tube 211, in this way constituting mechanical matching between two different standards which is defined by neither of the two standards.

A cylinder 27 can also envelop the external connector 22 to hold it rigidly and protect it so as to make the assembly very robust. The latter will preferably be made of an insulating material.

In a first embodiment, this cylinder 27 is made of two parts 271, 272 so as to hold the external connector 22 firmly when these two parts 271, 272 are joined together by means of screws 273. In a second embodiment, to improve the robustness and the tight seal of the connector, the external connector 22 is embedded in cold-setting material such as an insulating and resistant resin, this material constituting the cylinder 27 in a single piece which coats the external connector 22.

To keep the flexible circuit 24 in position the latter is fixed to the support plate 26 for example by means of a holding foot 29 which is screwed to the support plate 26 by means of screws 291 (two screws 291, here).

To protect the connection device the latter comprises a captive stopper (not shown) which is screwed onto the part external of the tube 212 of the socket body 21 which is threaded for this purpose. The stopper, which forms part of the first robust standard to which the socket body 21 responds, protects the external connector 22 when not in use. Such a stopper is withdrawn as soon as a user wants to connect a unit to the external connector 22 which is then accessible.

The invention claimed is:

1. A connection device comprising:

a socket body qualified according to a first standard supporting severe environments, the body socket body being hollow and intended to be fixed to a panel of an onboard item of equipment, the socket body comprising a fastening plate;

an external connector housed fixed in the socket body, the external connector being defined according to a second standard different to the first standard, said external connector being not qualified according to the first standard;

an internal connector connected to the external connector, said internal connector being configured to be connected to a card of the equipment;

a flexible impedance-matched transition housed at least partially in the socket body and arranged between the external connector and the internal connector configured, when operating, to adapt the impedance of the lines transiting between the internal connector and the external connector, the flexible impedance-matched transition comprising a flexible circuit connecting by means of lines of controlled impedance, a first printed circuit supporting the external connector and a second printed circuit supporting the internal connector; said first printed circuit being housed in said socket body;

a support plate supporting the first printed circuit, the first printed circuit being arranged between the support plate and the external connector, said support plate being fixed to the fastening plate of said socket body, said flexible circuit extending from the support plate to the internal connector.

2. The device according to claim 1, comprising a cylinder enclosing the external connector.

3. The device according to claim 1, wherein the internal connector and/or the external connector are respectively fixed on the first printed circuit and/or on the second printed circuit.

4. The device according to claim 1, wherein the cylinder is constituted by solidified material such as a resin.

5. The device according to claim 1, wherein the socket body is compatible with the standard MIL-DTL-38999, MIL-DTL-22992, MIL-DTL-26482.

* * * * *